US010163394B2

(12) United States Patent
Li

(10) Patent No.: US 10,163,394 B2
(45) Date of Patent: Dec. 25, 2018

(54) PIXEL CIRCUIT AND METHOD FOR DRIVING THE SAME, DISPLAY APPARATUS

(71) Applicant: BOE TECHNOLOGY GROUP CO., LTD., Beijing (CN)

(72) Inventor: Yunfei Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 54 days.

(21) Appl. No.: 15/321,010

(22) PCT Filed: Mar. 10, 2016

(86) PCT No.: PCT/CN2016/076054
§ 371 (c)(1),
(2) Date: Dec. 21, 2016

(87) PCT Pub. No.: WO2016/161866
PCT Pub. Date: Oct. 13, 2016

(65) Prior Publication Data

US 2017/0200414 A1 Jul. 13, 2017

(30) Foreign Application Priority Data

Apr. 10, 2015 (CN) ..... 2015 1 0171194

(51) Int. Cl.
*G09G 3/3258* (2016.01)
*G09G 3/3266* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
None
See application file for complete search history.

(56) References Cited

U.S. PATENT DOCUMENTS

2005/0093791 A1 5/2005 Lo
2011/0227903 A1 9/2011 Choi
2012/0019498 A1* 1/2012 Jeong ..... G09G 3/3233 345/211

FOREIGN PATENT DOCUMENTS

CN 102593151 A 7/2012
CN 102881255 A 1/2013
(Continued)

OTHER PUBLICATIONS

International Search Report dated May 30, 2016 issued on corresponding International Application No. PCT/CN2016/076054 along with an English translation of the Written Opinion of the International Searching Authority.
(Continued)

*Primary Examiner* — Kenneth B Lee, Jr.
(74) *Attorney, Agent, or Firm* — Nath, Goldberg & Meyer; Joshua B. Goldberg

(57) ABSTRACT

Pixel circuit, driving method therefor and display apparatus are provided. The pixel circuit includes driving transistor, light-emitting device, storage capacitor, gating module, compensating module and switching module. First end of storage capacitor is connected to gate electrode of driving transistor, and second end thereof is connected to first electrode of driving transistor. Compensating module includes reset sub-module having output terminal connected to second electrode of driving transistor and configured to charge first electrode of driving transistor in reset stage to store threshold voltage of driving transistor in storage capacitor, and voltage dividing sub-module having first terminal connected to first electrode of driving transistor and second terminal connected to high-level input terminal such that voltage dividing sub-module is connected in series with storage capacitor. According to the invention, the effect of
(Continued)

threshold voltage and IR drop on uniformity of display can be reduced, which improves display effect.

10 Claims, 2 Drawing Sheets

(51) Int. Cl.
*G09G 3/3291* (2016.01)
*G09G 3/3233* (2016.01)

(52) U.S. Cl.
CPC ..... *G09G 3/3291* (2013.01); *G09G 2300/043* (2013.01); *G09G 2300/0809* (2013.01); *G09G 2300/0819* (2013.01); *G09G 2300/0852* (2013.01); *G09G 2300/0861* (2013.01); *G09G 2310/0251* (2013.01); *G09G 2320/04* (2013.01); *G09G 2320/043* (2013.01)

(56) References Cited

FOREIGN PATENT DOCUMENTS

| | | | |
|---|---|---|---|
| CN | 102982766 | A | 3/2013 |
| CN | 103035202 | A | 4/2013 |
| CN | 103198793 | A | 7/2013 |
| CN | 103226931 | A | 7/2013 |
| CN | 104183215 | A | 12/2014 |
| CN | 104282263 | A | 1/2015 |
| CN | 104751799 | A | 7/2015 |

OTHER PUBLICATIONS

First Office Action dated Dec. 7, 2015 in corresponding Chinese Application No. 201510171194.6.
Second Office Action dated Feb. 26, 2016 in corresponding Chinese Application No. 201510171194.6.
Third Office Action dated Jun. 24, 2016 in corresponding Chinese Application No. 201510171194.6.

* cited by examiner

PIXEL CIRCUIT AND METHOD FOR DRIVING THE SAME, DISPLAY APPARATUS

This is a National Phase Application filed under 35 U.S.C. 371 as a national stage of PCT/CN2016/076054, filed Mar. 10, 2016, an application claiming the benefit of Chinese Application No. 201510171194.6, filed Apr. 10, 2015, the content of each of which is hereby incorporated by reference in its entirety.

FIELD OF THE INVENTION

The present invention relates to the field of display technology, and specifically relates to a pixel circuit, a method for driving the same, and a display apparatus including the same.

BACKGROUND

An organic light emitting diode (OLED), as a current-mode light-emitting device, has been more and more widely adopted in the field of display due to its characteristics such as self-luminous property, fast response, wide view angle and capability of being fabricated on a flexible substrate.

When an OLED device emits light, the current for driving all pixels is supplied from a backplane power supply. However, wire for the backplane power supply has a certain resistance, and therefore, power voltage applied to an area proximal to the location of the power supply is higher than that applied to an area distal to the location of the power supply. This phenomenon is known as IR drop, the larger the size of an OLED display, the more significant the phenomenon. In addition, each pixel circuit has a set of thin-film transistors (TFTs) and storage capacitors integrated therein, and the current flowing through an OLED is not only controlled by a data voltage, but also affected by a threshold voltage of the TFT. Since it is not possible for TFTs in a plurality of pixel circuits to have an identical property, difference exists between threshold voltages of TFTs in various pixel circuits, which thus leads to difference in current flowing through OLED device, and further has an effect on uniformity of brightness over a display screen.

SUMMARY

An object of the present invention is to provide a pixel circuit, a method for driving the same and a display apparatus so as to reduce the effect of threshold voltage and IR drop on uniformity of display.

To achieve at least the above object, according to an aspect of the present invention, there is provided a pixel circuit including a driving transistor, a light-emitting device, a storage capacitor, a gating module, a compensating module and a switching module. The gating module is connected between a data line and a gate electrode of the driving transistor, a first end of the storage capacitor is connected to the gate electrode of the driving transistor, and a second end of the storage capacitor is connected to a first electrode of the driving transistor. The compensating module includes a reset sub-module having an output terminal connected to a second electrode of the driving transistor and configured to charge the first electrode of the driving transistor in a reset stage so as to store a threshold voltage of the driving transistor in the storage capacitor, and a voltage dividing sub-module having a first terminal connected to the first electrode of the driving transistor and a second terminal connected to a high-level input terminal such that the voltage dividing sub-module is connected in series with the storage capacitor. The switching module is connected with the high-level input terminal and the driving transistor, respectively, and is configured to allow the high-level input terminal and the first electrode of the driving transistor to be electrically connected with each other in a light emitting stage. The light-emitting device is configured to emit light under the driving of the driving transistor.

The reset sub-module may include a first transistor, a reset control terminal and a reference voltage terminal. A gate electrode of the first transistor is connected to the reset control terminal, a first electrode of the first transistor is connected to the reference voltage terminal, and a second electrode of the first transistor is connected to the second electrode of the driving transistor.

The reset sub-module may include a first transistor and a reset control terminal. A gate electrode of the first transistor is connected to the reset control terminal, a first electrode of the first transistor is connected to the gate electrode of the driving transistor, and a second electrode of the first transistor is connected to the second electrode of the driving transistor.

The voltage dividing sub-module may include a voltage-dividing capacitor, a first end of which is formed as the first terminal of the voltage dividing sub-module, and a second end of which is formed as the second terminal of the voltage dividing sub-module.

The switching module may include a second transistor and a light-emission control signal terminal. A gate electrode of the second transistor is connected to the light-emission control signal terminal, a first electrode of the second transistor is connected to the high-level input terminal, and a second electrode of the second transistor is connected to the first electrode of the driving transistor.

The switching module may further be connected between the second electrode of the driving transistor and the light-emitting device such that the second electrode of the driving transistor and an anode of the light-emitting device are electrically connected to each other in the light emitting stage.

The switching module may include a second transistor, a third transistor and a light-emission control signal terminal. A gate electrode of the second transistor is connected to the light-emission control signal terminal, a first electrode of the second transistor is connected to the high-level input terminal, and a second electrode of the second transistor is connected to the first electrode of the driving transistor. A gate electrode of the third transistor is connected to the light-emission control signal terminal, a first electrode of the third transistor is connected to the second electrode of the driving transistor, and a second electrode of the third transistor is connected to the light-emitting device.

The gating module may include a fourth transistor, a gate electrode of which is connected to a scanning line, a first electrode of which is connected to the data line, and a second electrode of which is connected to the gate electrode of the driving transistor.

According to another aspect of the present invention, there is provided a method for driving a pixel circuit provided by the above-described aspect of the present invention, the driving method including a reset stage, a compensating stage and a light emitting stage. In the reset stage, the data line supplies a data voltage signal to the gate electrode of the driving transistor via the gating module, and the reset sub-module charges the first electrode of the driving transistor such that a threshold voltage signal of the driving transistor is stored in the storage capacitor. In the compensating stage, the data line supplies a preset voltage signal to the gate electrode of the driving transistor via the gating module, such that the data voltage signal and the threshold voltage signal are jointly stored in the storage capacitor. In the light emitting stage, the gating module is turned off, and the high-level input terminal and the first electrode of the driving transistor are electrically connected to each other through the switching module, such that the light-emitting device emits light.

The reset sub-module may include a first transistor, a reset control terminal and a reference voltage terminal. A gate electrode of the first transistor is connected to the reset control terminal, a first electrode of the first transistor is connected to the reference voltage terminal, and a second electrode of the first transistor is connected to the second electrode of the driving transistor. The voltage dividing sub-module includes a voltage-dividing capacitor, a first end of the voltage-dividing capacitor being formed as the first terminal of the voltage dividing sub-module, and a second end of the voltage-dividing capacitor being formed as the second terminal of the voltage dividing sub-module. The switching module includes a light-emission control signal terminal, a second transistor and a third transistor; a gate electrode of the second transistor and a gate electrode of the third transistor are connected with the light-emission control signal terminal, a first electrode of the second transistor is connected to the high-level input terminal, a second electrode of the second transistor is connected to the first electrode of the driving transistor, a first electrode of the third transistor is connected to the second electrode of the driving transistor, and a second electrode of the third transistor is connected to the light-emitting device. The gating module includes a fourth transistor, a first electrode of which is connected with the data line and a gate electrode of which is connected with a scanning line.

In the reset stage, both the reset control terminal and the scanning line are supplied with an on signal, the data line is supplied with a data voltage signal, the light-emission control signal terminal is supplied with an off signal, and the first electrode of the driving transistor is charged by the reference voltage terminal via the first transistor and the driving transistor.

In the compensating stage, the reset control terminal is supplied with an off signal, the scanning line is supplied with an on signal, the data line is supplied with a preset voltage signal, and the light-emission control signal terminal is supplied with an off signal.

In the light emitting stage, the reset control terminal is supplied with an off signal, the scanning line is supplied with an off signal, the data line is supplied with a preset voltage signal, and the light-emission control signal terminal is supplied with an on signal.

The first, second, third and fourth transistors and the driving transistor may be P-type transistors, the on signal is a low-level signal, and the off signal is a high-level signal.

According to another aspect of the present invention, there is provided a display apparatus including a pixel circuit provided by the above-described aspect of the present invention.

According to aspects of the present invention, the storage capacitor may store information on both the threshold voltage signal of the driving transistor and the data voltage signal provided by the data line before the light emitting stage, and the bootstrap effect of the storage capacitor allows the gate-source voltage of the driving transistor to remain the same in the compensating stage and the light emitting stage. Therefore, an amount of the driving current provided to the light-emitting device is independent of the threshold voltage and the voltage provided through the high-level input terminal, which reduces the effect of threshold voltage and IR drop on uniformity of display, and thereby improves display effect of the display apparatus.

BRIEF DESCRIPTION OF THE DRAWINGS

The accompanying drawings, which constitute a part of the specification, are provided for further understanding of the present invention, and for explaining the present invention together with the following specific implementations, but not intended to limit the present invention. In the drawings.

REFERENCE NUMERALS

10. light-emitting device; 20. gating module; 30. compensating module; 31. reset sub-module; 32. voltage dividing sub-module; 40. switching module; T1. first transistor; T2, second transistor; T3. third transistor; T4. fourth transistor; DTFT. driving transistor; C1. storage capacitor; C2. voltage-dividing capacitor; VDD. high-level input terminal; VSS. low-level input terminal; GATE. scanning line; DATA. data line; RESET. reset control terminal; EM. light-emission control signal terminal; SUS. reference voltage terminal.

DETAILED DESCRIPTION

Specific embodiments of the present invention will be described below in detail in conjunction with the accompanying drawings. It should be understood that the specific embodiments to be described herein are only intended to illustrate and explain the present invention, but not to limit the present invention.

Figure 1:
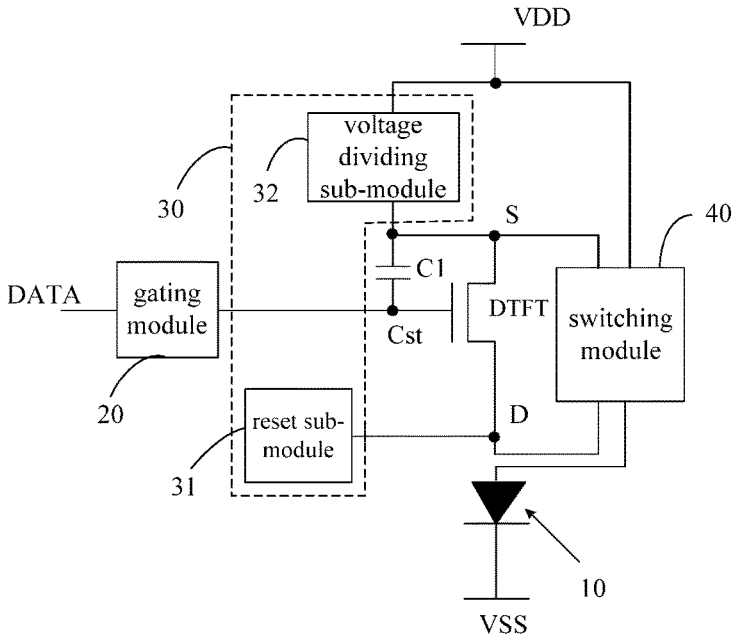
FIG. 1 is a structural block diagram of a pixel circuit in an embodiment of the present invention.

As an aspect of the present invention, there is provided a pixel circuit including a driving transistor DTFT, a light-emitting device 10, a storage capacitor C1, and a gating module 20, as shown in FIG. 1. An input terminal of the gating module 20 is connected to a data line DATA, an output terminal of the gating module 20 is connected to a gate electrode (i.e., the node Cst shown in FIG. 1) of the driving transistor DTFT, a first end of the storage capacitor C1 is connected to the gate electrode of the driving transistor DTFT, and a second end of the storage capacitor C1 is connected to a first electrode (i.e., the node S shown in FIG. 1) of the driving transistor DTFT The pixel circuit further includes a compensating module 30 and a switching module 40. The compensating module 30 includes a reset sub-module 31 having an output terminal connected to a second electrode (i.e., the node D shown in FIG. 1) of the driving transistor DTFT and configured to charge the first electrode of the driving transistor DTFT in a reset stage so as to store a threshold voltage $V_{th}$ of the driving transistor DTFT in the storage capacitor C1, and a voltage dividing sub-module 32 having a first terminal connected to the first electrode of the driving transistor DTFT and a second terminal connected to a high-level input terminal VDD such that the voltage dividing sub-module 32 is connected in series with the storage capacitor C1. The switching module 40 is connected with the high-level input terminal VDD and the driving transistor DTFT, respectively, and is configured to allow the high-level input terminal VDD and the first electrode of the driving transistor DTFT to be electrically connected with each other in a light emitting stage.

The data line DATA is configured to provide, to the gate electrode (the node Cst) of the driving transistor DTFT, a data voltage signal $V_{data}$ in the reset stage and a preset voltage signal $V_{ref}$ in a compensating stage, respectively. Since the voltage dividing sub-module 32 is connected in series with the storage capacitor C1, a voltage at the node S changes accordingly in the reset stage and the compensating stage, and the ratio of the change in the voltage at the node S to the change in the voltage at the node Cst equals to a constant $\alpha$ less than 1, such that the voltage stored by the storage capacitor C1 includes not only the information on the threshold voltage $V_{th}$ stored in the reset stage but also the information on the voltage provided by the data line to the node Cst in the reset stage and the compensating stage, respectively. Specifically, in the compensating stage, the voltage stored in the storage capacitor C1 equals to $V_{ref}-[(V_{data}-V_{th})+\alpha(V_{ref}-V_{data})]$, the value of which is independent of the voltage at the high-level input terminal VDD. In the light emitting stage, when the high-level signal $V_{dd}$ of the high-level input terminal VDD is input to the node S via the switching module 40, the gate-source voltage of the driving transistor DTFT remains the same as the voltage between both ends of the storage capacitor C1 in the compensating stage due to the bootstrap effect of the storage capacitor C1, i.e., $V_{gs}=V_{ref}-[(V_{data}-V_{th})+\alpha(V_{ref}-V_{data})]$. Therefore, the current for driving the light-emitting device in the light emitting stage is as follows:

$$\begin{aligned} I_{oled} &= 0.5\ \mu_n C_{ox}(W/L)(V_{gs}-V_{th})\text{^}2 \\ &= 0.5\ \mu_n C_{ox}(W/L)\{V_{ref}-[(V_{data}-V_{th})+\alpha(V_{ref}-V_{data})]-V_{th}\}\text{^}2 \\ &= 0.5\ \mu_n C_{ox}(W/L)[(1-\alpha)(V_{ref}-V_{data})]\text{^}2, \end{aligned}$$

where $\mu_a$ refers to mobility of carriers, $C_{ox}$ refers to capacitance of the gate oxide layer of the driving transistor, and W/L refers to the width-to-length ratio of the conduction channel of the driving transistor. It can be found that the driving current is independent of both the threshold voltage $V_{th}$ and the high-level signal $V_{dd}$, and thus the threshold voltage and the IR drop are compensated efficiently, thereby improving uniformity of a display screen.

Figure 2:
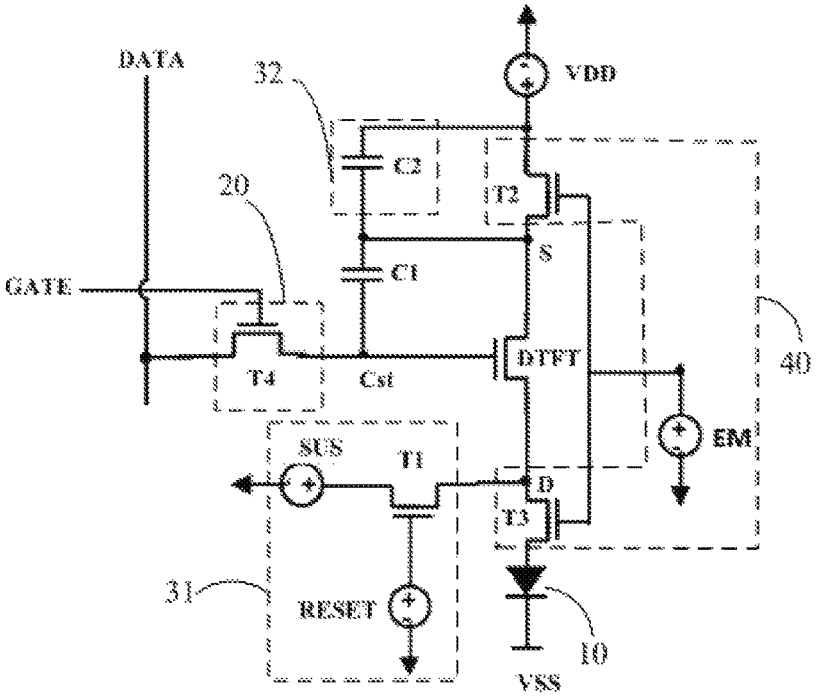
FIG. 2 is a detailed structural schematic diagram of a pixel circuit in a first embodiment of the present invention.

As a first embodiment of the present invention, the reset sub-module 31 includes a first transistor T1, a reset control terminal RESET and a reference voltage terminal SUS, as shown in FIG. 2. A gate electrode of the first transistor T1 is connected to the reset control terminal RESET, a first electrode of the first transistor T1 is connected to the reference voltage terminal SUS, and a second electrode of the first transistor T1 is connected to the second electrode of the driving transistor DTFT.

In the reset stage, the reset control terminal RESET is supplied with an on signal such that the first transistor T1 is turned on, and a reference voltage signal from the reference voltage terminal SUS is input to the second electrode (the node D) of the driving transistor DTFT via the first transistor T1.

Take the driving transistor DTFT as a P-type transistor for example. In the reset stage, the gating module 20 is turned on and the data voltage signal $V_{data}$ is input to the gate electrode (the node Cst) of the driving transistor DTFT, while the voltage at the first electrode (the node S) of the driving transistor DTFT remains the voltage value in the previous stage, i.e., the high-level signal $V_{dd}$ provided by the high-level input terminal; it allows the voltage $V_{gs}$ of the driving transistor DTFT to be less than zero, such that the driving transistor DTFT is turned on, and the node S is charged by the reference voltage terminal SUS till the driving transistor DTFT is turned off. At this time, the voltage at the node S equals to $V_{data}-V_{th}$, the voltage at the node Cst equals to $V_{data}$, and the voltage between both ends of the storage capacitor C1 equals to $V_{th}$.

Figure 3:
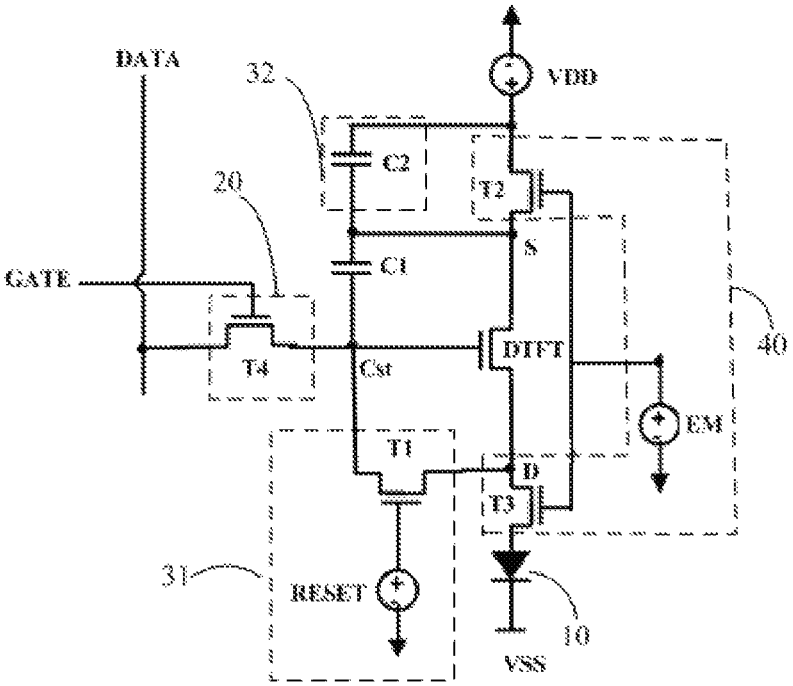
FIG. 3 is a detailed structural schematic diagram of a pixel circuit in a second embodiment of the present invention.

As a second embodiment of the present invention, the reset sub-module 31 includes a first transistor T1 and a reset control terminal RESET, as shown in FIG. 3. A gate electrode of the first transistor T1 is connected to the reset control terminal RESET, a first electrode of the first transistor T1 is connected to an output terminal of a gating module 20, and a second electrode of the first transistor T1 is connected to the second electrode of the driving transistor DTFT. For example, the first electrode of the driving transistor DTFT may be a source electrode and the second electrode thereof may be a drain electrode.

As compared with the first embodiment, in the reset sub-module 31 of the second embodiment, the gate electrode of the driving transistor DTFT is charged by the data line DATA in the reset stage such that the voltage at the node Cst reaches the data voltage $V_{data}$, and, in the meantime, the node S is charged by the data line DATA via the first transistor T1. It can be understood by those skilled in the art that, in the second embodiment as shown in FIG. 3, the charging of the node S can be completed only when the driving transistor DTFT is an enhanced thin-film transistor, while the first electrode of the driving transistor DTFT cannot be charged when the driving transistor DTFT is a depleted thin-film transistor. This is because the condition for turning on a depleted thin-film transistor is that the voltage of the first electrode thereof needs to be larger than that of the gate electrode thereof, however, this condition cannot be satisfied in a case where the data line DATA charges both the gate electrode and the source electrode of the driving transistor DTFT simultaneously. In contrast, the embodiment as shown in FIG. 2 may be adopted for not only an enhanced thin-film transistor but also a depleted thin-film transistor.

Specifically, as shown in FIGS. 2 and 3, the voltage dividing sub-module 32 includes a voltage-dividing capacitor C2, a first end of which is formed as the first terminal of the voltage dividing sub-module 32, and a second end of which is formed as the second terminal of the voltage dividing sub-module 32. That is, the first end of the voltage-dividing capacitor C2 is connected to the first electrode of the driving transistor DTFT, and the second end of the voltage-dividing capacitor C2 is connected to high-level input terminal VDD.

As shown in FIGS. 2 and 3, the switching module 40 includes a second transistor T2 and a light-emission control signal terminal EM. A gate electrode of the second transistor T2 is connected to the light-emission control signal terminal EM, a first electrode of the second transistor T2 is connected to the high-level input terminal VDD, and a second electrode of the second transistor T2 is connected to the first electrode of the driving transistor DTFT. In the light emitting stage, the light-emission control signal terminal EM is supplied with an on signal such that the second transistor T2 is turned on, and hence the high-level signal of the high-level input terminal VDD is input to the first electrode of the driving transistor DTFT via the second transistor T2.

The switching module 40 may further be connected to the light-emitting device, such that the second electrode of the driving transistor DTFT and an anode of the light-emitting device 10 are electrically connected to each other in the light emitting stage. The switching module 40 is turned off in both the reset stage and the compensating stage so as to prevent current from flowing through the light-emitting device and the light-emitting device from emitting light.

Specifically, as shown in FIGS. 2 and 3, the switching module 40 further includes a third transistor T3, a gate electrode of which is connected to the light-emission control signal terminal EM, a first electrode of which is connected to the second electrode of the driving transistor DTFT, and a third electrode of which is connected to the anode of the light-emitting device 10.

The gating module 20 may include a fourth transistor T4, a gate electrode of which is connected to a scanning line GATE, a first electrode of which is connected to the data line DATA, and a second electrode of which is connected to the gate electrode of the driving transistor DTFT. The fourth transistor T4 is turned on when the scanning line GATE is supplied with an on signal, such that the signal on the data line DATA is input to the gate electrode of the driving transistor DTFT via the fourth transistor T4.

In the embodiments of the present invention, the first transistor T1 to the fourth transistor T4 and the driving transistor DTFT are all P-type transistors, the first electrodes thereof are source electrodes, and the second electrodes thereof are drain electrodes; and accordingly, the on-signal is a low-level signal and the off signal is a high-level signal. It is needless to say that, the transistors may all be N-type transistors, or part of the transistors are N-type transistors and part of the transistors are P-type transistors, as long as voltages applied to respective gate electrodes of the transistors are adjusted correspondingly such that each transistor has the same conduction state as that of the present invention in all stages.

The driving procedure of the pixel circuit in the present invention includes three stages: the reset stage, the compensating stage and the light emitting stage. Each stage will be described below in conjunction with FIG. 4, by taking the structure of the first embodiment (as shown in FIG. 2) for example.

Figure 4:
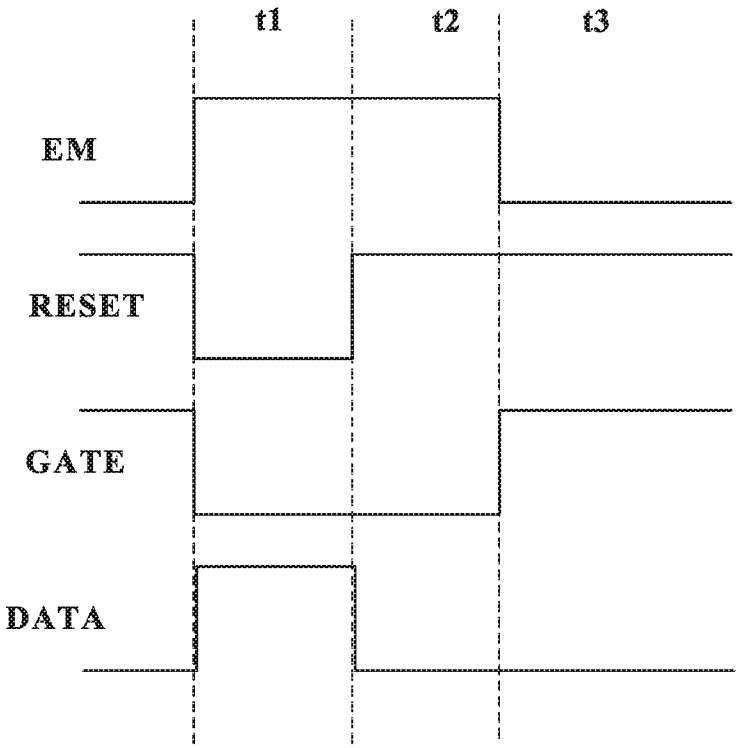
FIG. 4 is a timing diagram for driving signal terminals of a pixel circuit in an embodiment of the present invention.

In the reset stage (the stage t1 as shown in FIG. 4), the scanning line GATE and the reset control terminal RESET are supplied with low-level signals, and the light-emission control terminal EM and the data line DATA are supplied with high-level signals. At this time, the first transistor T1 and the fourth transistor T4 are turned on, and the second transistor T2 and the third transistor T3 are turned off. The high-level data signal $V_{data}$ on the data line DATA is input to the gate electrode of the driving transistor DTFT via the fourth transistor T4, so the driving transistor DTFT is turned on, and the reference voltage terminal SUS charges the node S via the first transistor T1 and the driving transistor DTFT till the voltage at the node S reaches the value of $V_{data}-V_{th}$.

In this stage, in order to ensure the driving transistor DTFT to be turned on, the high-level signal $V_{dd}$ of the high-level input terminal VDD should satisfy the condition $V_{dd}>V_{data,max}-V_{th}$, and the reference voltage signal $V_{sus}$ of the reference voltage terminal SUS should satisfy the condition $V_{sus}<V_{data,min}-Vth$, wherein $V_{data,max}$ is the maximum value among a plurality of data voltage signals $V_{data}$ corresponding to the writing of various grey-scale signals, and $V_{data,min}$ is the minimum value among the plurality of data voltage signals $V_{data}$.

In the compensating stage (the stage t2 as shown in FIG. 4), the scanning line GATE and the data line DATA are supplied with low-level signals, and the light-emission control terminal EM and the reset control terminal RESET are supplied with high-level signals, wherein the low-level signal on the data line DATA is the preset voltage signal $V_{ref}$. In this stage, the fourth transistor T4 is turned on, and the first transistor T1, the second transistor T2 and the third transistor T3 are turned off. The voltage at the node Cst changes from the data voltage signal $V_{data}$ in the reset stage to the preset voltage single $V_{ref}$ in the compensating stage, and the node S is floating, at which the voltage is affected by the voltage at the node Cst. The change $\Delta V_{cst}$ of the voltage at the node Cst between the reset stage and the compensating stage is fed back to the node S. Due to the voltage-dividing effect of the voltage-dividing capacitor C2, the change $\Delta V_s$ of the voltage at the node S between the reset stage and the compensating stage equals to [C1/(C1+C2)](Vref−Vdata), and thus the voltage at the node S in the compensating stage equals to $(V_{data}-V_{th})+[C1/(C1+C2)](V_{ref}-V_{data})$. It can be found that, in the compensating stage, the voltage information stored in the storage capacitor C1 includes the voltage information on both $V_{data}$ and $V_{th}$.

In this stage, in order to ensure the driving transistor DTFT to be normally turned on while reducing the current flowing through the light emitting module to assure the effect of the black state, the low-level signal $V_{ref}$ of the data line may be equal to or slightly larger than the minimum value $V_{data,min}$ of the data voltage signal(s) supplied in the reset stage.

In the light emitting stage (the stage t3 as shown in FIG. 4), the light-emission control terminal EM and the data line DATA are supplied with low-level signals, and the reset control terminal RESET and the scanning line GATE are supplied with high-level signals. At this time, the first transistor T1 and the fourth transistor T4 are turned off, and the second transistor T2 and the third transistor T3 are turned on. The high-level signal terminal VDD charges the node S, the first electrode of the driving transistor DTFT, via the second transistor T2, such that the voltage at the node S increases from the value of $(V_{data}-V_{th})+[C1/(C1+C2)](V_{ref}-V_{data})$ to the value of $V_{dd}$. The gate-source voltage of the driving transistor DTFT remains the same as the voltage between both ends of the storage capacitor C1 in the compensating stage due to the bootstrap effect of the storage capacitor C1, i.e., $$V_{gs}=V_{ref}-\{(V_{data}-V_{th})+[C1/(C1+C2)](V_{ref}-V_{data})\}.$$

Therefore, the current flowing through the light-emitting device equals to:

$$\begin{aligned} I_{oled} &= 0.5\ \mu_n C_{ox}(W/L)(V_{gs}-V_{th})\text{^}2 \\ &= 0.5\ \mu_n C_{ox}(W/L)\{[1-C1/(C1+C2)](V_{ref}-V_{data})\}\text{^}2 \\ &= 0.5\ \mu_n C_{ox}(W/L)\{[(C2)/(C1+C2)](V_{ref}-V_{data})\}\text{^}2 \end{aligned}$$

where $\mu_n$ refers to mobility of carriers, $C_{ox}$ refers to capacitance of the gate oxide layer of the driving transistor, and W/L refers to the width-to-length ratio of the conduction channel of the driving transistor. It can be found that the current flowing through the light-emitting device 10 is independent of both $V_{th}$ and $V_{dd}$, and thus the nonuniformity of the threshold voltage and the IR drop are compensated efficiently, thereby improving uniformity of a display screen.

As another aspect of the present invention, there is provided a method for driving the above-described pixel circuit, the driving method including a reset stage, a compensating stage and a light emitting stage.

In the reset stage, the data line DATA supplies a data voltage signal $V_{data}$ of high level to the gate electrode of the driving transistor DTFT via the gating module 20, and the first electrode of the driving transistor DTFT is charged by the reset sub-module 31 so as to store the threshold voltage signal $V_{th}$ of the driving transistor DTFT in the storage capacitor C1;

in the compensating stage, the data line DATA supplies a preset voltage signal $V_{ref}$ of low level to the gate electrode of the driving transistor DTFT via the gating module 20, such that the data voltage signal $V_{data}$ of high level and the threshold voltage signal $V_{th}$ are jointly stored in the storage capacitor C1; and in the light emitting stage, the gating module 20 is turned off, and the high-level input terminal VDD and the first electrode of the driving transistor DTFT are electrically connected to each other through the switching module 40, such that the light-emitting device 10 emits light.

Specifically, as shown in FIG. 2, the reset sub-module 31 includes the first transistor T1, the reset control terminal RESET and the reference voltage terminal SUS; the voltage dividing sub-module 32 includes the voltage-dividing capacitor C2; the switching module 40 includes the light-emission control signal terminal EM, the second transistor T2 and the third transistor T3; and the gating module 20 includes the fourth transistor T4.

As shown in FIG. 4, in the reset stage (the stage t1), both the reset control terminal RESET and the scanning line GATE are supplied with on signals, the data line DATA is supplied with the data voltage signal $V_{data}$ of high level, and the reference voltage terminal SUS charges the first electrode of the driving transistor DTFT. In this stage, the first transistor T1, the fourth transistor T4 and the driving transistor DTFT are turned on, the data voltage signal $V_{data}$ of high level is input to the gate electrode of the driving transistor DTFT via the fourth transistor T4, and the reference voltage signal $V_{SUS}$ of the reference voltage terminal SUS charges the node S via the first transistor T1 and the driving transistor DTFT till the driving transistor DTFT is turned off. At this time, the voltage at the node S reaches the value of $V_{data}-V_{th}$, the voltage at the node Cst equals to $V_{data}$, and the voltage stored in the storage capacitor C1 equals to $V_{th}$.

In the compensating stage (the stage t2), the reset control terminal RESET is supplied with an off signal, the scanning line GATE is supplied with an on signal, and the data line DATA is supplied with the preset voltage signal $V_{ref}$ of low level, so the first transistor T1 is turned off and the fourth transistor T4 is turned on, and the preset voltage signal $V_{ref}$ of low level is input to the node Cst through the data line DATA. In the reset stage and the compensating stage, the signal of the light-emission control signal terminal EM remains as an off signal, such that the second transistor T2 and the third transistor T3 are turned off in both of the stages, and the node S is floating, at which the voltage is affected by the voltage at the node Cst and thus changes to the value of $(V_{data}-V_{th})+[C1/(C1+C2)](V_{ref}-V_{data})$.

In the light emitting stage (the stage t3), the scanning line GATE is supplied with an off signal and the light-emission control signal terminal EM is supplied with an on signal, such that the fourth transistor T4 is turned off, the second transistor T2 and the third transistor T3 are turned on, and the high-level voltage $V_{dd}$ of the high-level input terminal VDD is input to the node S and drives the light-emitting device 10 to emit light. The voltage between the gate electrode and the source electrode of the driving transistor DTFT remains the same as that in the compensating stage due to the bootstrap effect of the storage capacitor C1, that is, is independent of the high-level signal $V_{dd}$.

The first transistor T1 to the fourth transistor T4 and the driving transistor DTFT are all P-type transistors, and accordingly, the on signal is a low-level signal and the off signal is a high-level signal.

In the pixel circuit provided by the present invention, the voltage stored in the storage capacitor before the light emitting stage includes the information on the threshold voltage, and the voltage stored in the storage capacitor in the light emitting stage is independent of the voltage of the high-level input terminal. Therefore, the current flowing through the light-emitting device is independent of both the threshold voltage and the voltage of the high-level input terminal, and thus the nonuniformity of the threshold voltage and the IR drop can be compensated, thereby improving uniformity of a display screen.

As still another aspect of the present invention, there is provided a display apparatus including the above-described circuit provided by the present invention.

The display apparatus may be any product or component with the display function, such as a mobile phone, a tablet computer, a television, a monitor, a notebook computer, a digital photo frame, a navigator or the like.

Since the pixel circuit provided in the present invention has excellent stability without being affected by the threshold voltage of a transistor in the circuit and the IR drop of the backplane power supply, the driving current is not affected by the threshold voltage of the transistor and the backplane unit, thereby improving the display effect and prolonging the lifetime of the light-emitting device.

It can be understood that the foregoing implementations are merely exemplary implementations used for describing the principle of the present invention, but the present invention is not limited thereto. Those of ordinary skill in the art may make various variations and improvements without departing from the spirit and essence of the present invention, and these variations and improvements shall also fall into the protection scope of the present invention.

What is claimed is:

1. A method for driving a pixel circuit, the pixel circuit comprising a driving transistor, a light-emitting device, a storage capacitor, a gating circuit, a compensating circuit and a switching circuit, the gating circuit being connected between a data line and a gate electrode of the driving transistor, a first end of the storage capacitor being connected to the gate electrode of the driving transistor, and a second end of the storage capacitor is connected to a first electrode of the driving transistor; the compensating circuit comprising: a reset sub-circuit having an output terminal connected to a second electrode of the driving transistor and configured to charge the first electrode of the driving transistor in a reset stage so as to store a threshold voltage of the driving transistor in the storage capacitor, and a voltage dividing sub-circuit having a first terminal connected to the first electrode of the driving transistor and a second terminal connected to a high-level input terminal, such that the voltage dividing sub-circuit is connected in series with the storage capacitor; the switching circuit being connected with the high-level input terminal and the driving transistor, respectively, and being configured to allow the high-level input terminal and the first electrode of the driving transistor to be electrically connected with each other in a light emitting stage; and the light-emitting device being configured to emit lilt under the driving of the driving transistor, the method comprising:

a reset stage, in which the data line supplies a data voltage signal to the gate electrode of the driving transistor via the gating circuit, and the reset sub-circuit is turned on to charge the first electrode of the driving transistor such that a threshold voltage signal of the driving transistor is stored in the storage capacitor;

a compensating stage, in which the data line supplies a preset voltage signal to the gate electrode of the driving transistor via the gating circuit, such that the data voltage signal and the threshold voltage signal are jointly stored in the storage capacitor; and a light emitting stage, in which the gating circuit is turned off, and the high-level input terminal and the first electrode of the driving transistor are electrically connected to each other through the switching circuit, such that the light-emitting device emits light.

2. The method according to claim 1, wherein the reset sub-circuit comprises a first transistor, a reset control terminal and a reference voltage terminal, a gate electrode of the first transistor being connected to the reset control terminal, a first electrode of the first transistor being connected to the reference voltage terminal, and a second electrode of the first transistor being connected to the second electrode of the driving transistor; the voltage dividing sub-circuit comprises a voltage dividing capacitor, a first end of the voltage dividing capacitor being formed as a first terminal of the voltage dividing sub-circuit and a second end of the voltage dividing capacitor being formed as a second terminal of the voltage dividing sub-circuit; the switching circuit comprises a light-emission control signal terminal, a second transistor and a third transistor, a gate electrode of the second transistor and a gate electrode of the third transistor being connected with the light-emission control signal terminal, a first electrode of the second transistor being connected to the high-level input terminal, a second electrode of the second transistor being connected to the first electrode of the driving transistor, a first electrode of the third transistor being connected to the second electrode of the driving transistor, and a second electrode of the third transistor being connected to the light emitting-device; and the gating circuit comprises a fourth transistor, a first electrode of the fourth transistor being connected with a data line and a gate electrode of the fourth transistor being connected with a scanning line;

in the reset stage, both the reset control terminal and the scanning line are supplied with an on signal, the data line is supplied with a data voltage signal, the light-emission control signal terminal is supplied with an off signal, and the first electrode of the driving transistor is charged by the reference voltage terminal via the first transistor and the driving transistor;

in the compensating stage, the reset control terminal is supplied with an off signal, the scanning line is supplied with an on signal, the data line is supplied with a preset voltage signal, and the light-emission control signal terminal is supplied with an off signal; and in the light emitting stage, the reset control terminal is supplied with an off signal, the scanning line is supplied with an off signal, the data line is supplied with a preset voltage signal, and the light-emission control signal terminal is supplied with an on signal.

3. The method according to claim 2, wherein the first transistor, the second transistor, the third transistor, the fourth transistor and the driving transistor are P-type transistors, the on signal is a low-level signal, and the off signal is a high-level signal.

4. The method according to claim 1, wherein the reset sub-circuit comprises a first transistor, a reset control terminal and a reference voltage terminal, a gate electrode of the first transistor being connected to the reset control terminal, a first electrode of the first transistor being connected to the reference voltage terminal, and a second electrode of the first transistor being connected to the second electrode of the driving transistor.

5. The method according to claim 1, wherein the reset sub-circuit comprises a first transistor and a reset control terminal, a gate electrode of the first transistor being connected to the reset control terminal, a first electrode of the first transistor being connected to the gate electrode of the driving transistor, and a second electrode of the first transistor being connected to the second electrode of the driving transistor.

6. The method according to claim 1, wherein the voltage dividing sub-circuit comprises a voltage-dividing capacitor, a first end of the voltage-dividing capacitor being formed as a first terminal of the voltage dividing sub-circuit, and a second end of the voltage-dividing capacitor being formed as a second terminal of the voltage dividing sub-circuit.

7. The method according to claim 1, wherein the switching circuit comprises a second transistor and a light-emission control signal terminal, a gate electrode of the second transistor being connected to the light-emission control signal terminal, a first electrode of the second transistor being connected to the high-level input terminal, and a second electrode of the second transistor being connected to the first electrode of the driving transistor.

8. The method according to claim 1, wherein the switching circuit is connected between the second electrode of the driving transistor and the light-emitting device such that the second electrode of the driving transistor and an anode of the light-emitting device are electrically connected to each other in the light emitting stage.

9. The method according to claim 8, wherein the switching circuit comprises a second transistor, a third transistor and a light-emission control signal terminal, a gate electrode of the second transistor being connected to the light-emission control signal terminal, a first electrode of the second transistor being connected to the high-level input terminal, a second electrode of the second transistor being connected to the first electrode of the driving transistor, a gate electrode of the third transistor being connected to the light-emission control signal terminal, a first electrode of the third transistor being connected to the second electrode of the driving transistor, and a second electrode of the third transistor being connected to the light-emitting device.

10. The method according to claim 1, wherein the gating circuit comprises a fourth transistor, a gate electrode of the fourth transistor being connected to a scanning line, a first electrode of the fourth transistor being connected to the data line, and a second electrode of the fourth transistor being connected to the gate electrode of the driving transistor.

* * * * *